US005230100A

United States Patent [19]

Lock-Jones

[11] Patent Number: 5,230,100

[45] Date of Patent: Jul. 27, 1993

[54] COLLAR, CHOKER, OR NECK BAND

[76] Inventor: Mary G. S. Lock-Jones, 2356 15th Ave. South #103, Seattle, Wash. 98144

[21] Appl. No.: 741,143

[22] Filed: Aug. 7, 1991

[51] Int. Cl.[5] ..... A41D 27/16

[52] U.S. Cl. ..... 2/50; 2/60; 2/174

[58] Field of Search ..... 2/50, 51, 60, 91, 170, 2/174, 311, 338, DIG. 11; 128/157; 119/106

[56] References Cited

U.S. PATENT DOCUMENTS

| | | | |
|---|---|---|---|
| 1,518,293 | 12/1924 | Zang | 2/50 |
| 1,723,018 | 8/1929 | Dunlap | 2/50 |
| 2,029,417 | 2/1936 | Forster | 2/50 |
| 2,116,685 | 5/1938 | Nicolet | 2/50 |
| 2,510,720 | 6/1950 | Seigel | 2/91 |
| 2,638,599 | 5/1953 | Flink | 2/170 |
| 3,200,413 | 8/1965 | Vaughan | 2/60 |
| 3,479,667 | 11/1969 | Mehl | 2/91 X |
| 3,646,614 | 3/1972 | Engelmann | 2/91 |
| 3,949,875 | 4/1976 | Catania et al. | 2/50 X |
| 4,047,400 | 9/1977 | Thorneburg | 2/170 |
| 4,190,903 | 3/1980 | Kinsella | 2/60 |
| 4,384,583 | 5/1983 | Speelman et al. | 2/338 |
| 4,521,922 | 6/1985 | Mitchell et al. | 2/DIG. 11 |
| 4,653,119 | 3/1987 | Kaiser | 2/60 |
| 4,654,897 | 4/1987 | Rosaen | 2/91 X |
| 4,656,671 | 4/1987 | Manges | 2/DIG. 1 X |
| 4,843,653 | 7/1989 | Coble | 2/170 |
| 4,939,794 | 7/1990 | Aronson | 2/128 |
| 5,023,954 | 6/1991 | Lyons | 2/174 |

FOREIGN PATENT DOCUMENTS

| | | | |
|---|---|---|---|
| 0373824 | 6/1990 | European Pat. Off. | 2/50 |
| 816134 | 7/1949 | Fed. Rep. of Germany | 2/50 |
| 597852 | 4/1978 | Switzerland | 2/170 |
| 27572 | of 1909 | United Kingdom | 2/60 |

*Primary Examiner*—Clifford D. Crowder
*Assistant Examiner*—Jeanette E. Chapman
*Attorney, Agent, or Firm*—James Richard Vance

[57] ABSTRACT

Apparatus and methods for absorbing liquid and/or stopping cut hair from running down a neck of a person when that person's hair is washed and/or cut. The apparatus comprises: a length of cloth or other liquid absorbent material which serves as an adjustable, removable collar, choker, or neck band that may be secured to the neck of the person; and means for fastening and securing respective ends of the choker or neck band around the neck of the person to provide an adequately close but comfortable fit. A relatively large protective cape may then be placed over the choker or neck band. The apparatus is reusable, and serves as a medium into which lengths of cut hair may be pierced, impaled, or imbedded, and thereby captured.

1 Claim, 2 Drawing Sheets

COLLAR, CHOKER, OR NECK BAND

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to apparatus and methods for absorbing liquid and/or stopping hair from running down a person's neck when that person's hair is washed or cut; and more specifically, for apparatus and methods which use a strip of absorbent, adjustable, reusable cloth or other liquid absorbent material as a collar, choker, or neck band under a relatively large protective cape.

BACKGROUND ART

It is a common practice within the commercial hair salon industry to place a relatively large protective cape around the neck and over the clothing of a person or customer having his or her hair washed and/or cut. The protective cape is primarily used to direct liquid and cut hair away from the person's clothing.

To prevent the neck of the protective cape from becoming soiled, it is also common to initially place a strip of very thin, disposable paper tissue around the neck of the customer prior to placement of the cape. The thin, disposable paper tissue is sandwiched or juxtaposed between the neck of the customer and the inner-side of the cape.

The thin, disposable paper tissue used in the prior art is inadequate to absorb any significant amount of liquid passing down the neck of the customer. Consequently, use of several paper tissues stacked upon one another is required, and this still does not eliminate the problem. It is readily apparent after even the first use of such paper tissues that the tissues are not intended to accomplish the tasks at hand, but are simply used to protect the cape's collar from becoming soiled against the person's neck, and possibly to prevent chaffing of the cape's collar against the person's neck.

Various devices have been developed in an attempt to overcome these difficulties. For example, the following issued patents describe two different protective collars which are intended to prevent liquid and cut hair from passing down the neck of a person or customer: Nicolet (U.S. Pat. No. 2,116,685, issued May 10, 1938); and Kinsella (U.S. Pat. No. 4,190,903, issued Mar. 4, 1980).

During the course of a novelty search, which was conducted for the present invention, the following patents were also discovered: Flink (U.S. Pat. No. 2,638,599, issued May 19, 1953); and Aronson (U.S. Pat. No. 4,939,794, issued Jul. 10, 1990).

The inventor believes that the listed patents taken alone or in combination neither anticipate nor render obvious the present invention. These citations do not constitute an admission that such disclosures are relevant or material to the present claims. Rather, these citations relate only to the general field of the disclosure and are cited as constituting the closest art of which the inventor is aware.

DISCLOSURE OF INVENTION

Large protective capes are often used within the hair dressing, barber, makeup, and entertainment industries to prevent liquids, cut hair, and makeup from soiling and/or staining clothing. For example, such a cape is usually placed around the neck of a person having his or her hair washed and/or cut. The cape could equally be used to protect the clothing of a person to whom makeup is applied. This invention contemplates the continued use of such a cape.

The present invention is an improvement upon a collar, choker, or neck band which may be juxtaposed between a relatively large protective cape and the neck of the person wearing the cape. The collar is extremely simple and inexpensive to manufacture. The collar is easy to use. The collar is soft, adjustable, comfortable, absorbent, functional, efficient, reliable, rugged, durable, and reusable. The collar quickly and efficiently absorbs liquid, and serves as a barrier to prevent cut hair from passing down the neck of a person wearing the cape.

The present invention goes even further to serve as a medium into which cut hair may be pierced, impaled, or imbedded and, thereby, captured. Consequently, such cut hair is prevented from passing down the neck of the person. This latter structure and feature are especially helpful when the collar is removed.

To achieve these general and specific objectives, and to overcome the disadvantages of the prior art, the present invention generally comprises an elongated length of cloth, and means for fastening and securing the length of cloth about a neck of a person.

The length of cloth defines a collar, choker, or neck band. The cloth is extremely absorbent and serves as a gasket or seal which is positioned between the protective cape and the neck of the person. Such placement enables the cloth to prevent liquid and cut hair from passing down the neck of the person or customer.

The means for fastening the respective ends of the cloth enables the device to be quickly and easily adjusted for different girths of neck sizes. This enables a single device of the present invention to be successively used with numerous different persons, including adults having large neck sizes and children having smaller neck sizes.

The present invention is comfortable during use and does not scrape against the side of the person's neck. The soft and absorbent texture of the cloth prevents chaffing of the device against the person's neck.

The invention also protects the collar of the cape from becoming soiled.

Since the cloth is separable from the cape, the cloth can be quickly and easily removed and set aside for later laundering. Consequently, the cloth of the present invention may be reused over and over again.

In the preferred embodiment, the cloth comprises a single strip of terry cloth fabric, or similar material having means which enable the cut hair to be imbedded therein. For example, the cloth may comprise a strip of fabric generally about two inches (2") wide and ten to twenty inches (10"-20") long. The length of the strip of cloth is dependent upon the girth of the customer's neck and may be longer or shorter, wider or narrower than the preferred embodiment. The length of the cloth should, however, be long enough to overlap the respective ends of the cloth when wrapped around the neck of the person.

The invention is also provided with means for fastening and securing the overlapped ends of the cloth about the neck of the person. In the preferred embodiment, the fastening means comprises a hook and loop fastener system commonly sold under the trademark VELCRO. In an alternative embodiment, a series of snaps may be placed along the length of the strip to enable adjustment of the cloth for differing girths.

The invention may also comprise use of a powder which may be sprinkled onto the cloth and/or onto the neck of the person. The powder serves to lubricate the cloth and neck of the person so that chaffing is eliminated. The powder also serves to absorb any moisture that may be between the cloth and the neck of the person.

The present invention achieves each of the above-stated objectives and overcomes the previously mentioned disadvantages of such prior devices.

These and other objectives and advantages of the present invention will become more readily apparent upon reading the following disclosure and referring to the attached drawings.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Figure 1:
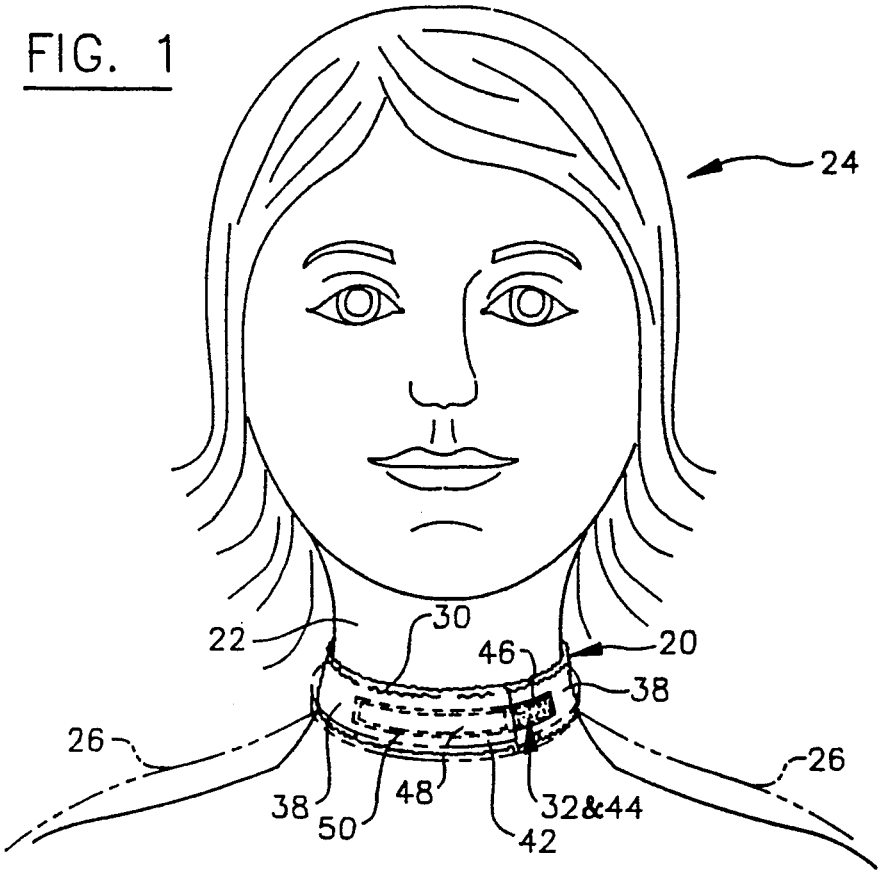
FIG. 1 is a schematic, front-elevational view of the invention, as taught herein, depicting the general appearance of the cloth collar, choker, or neck band of the preferred embodiment.
Figure 2:
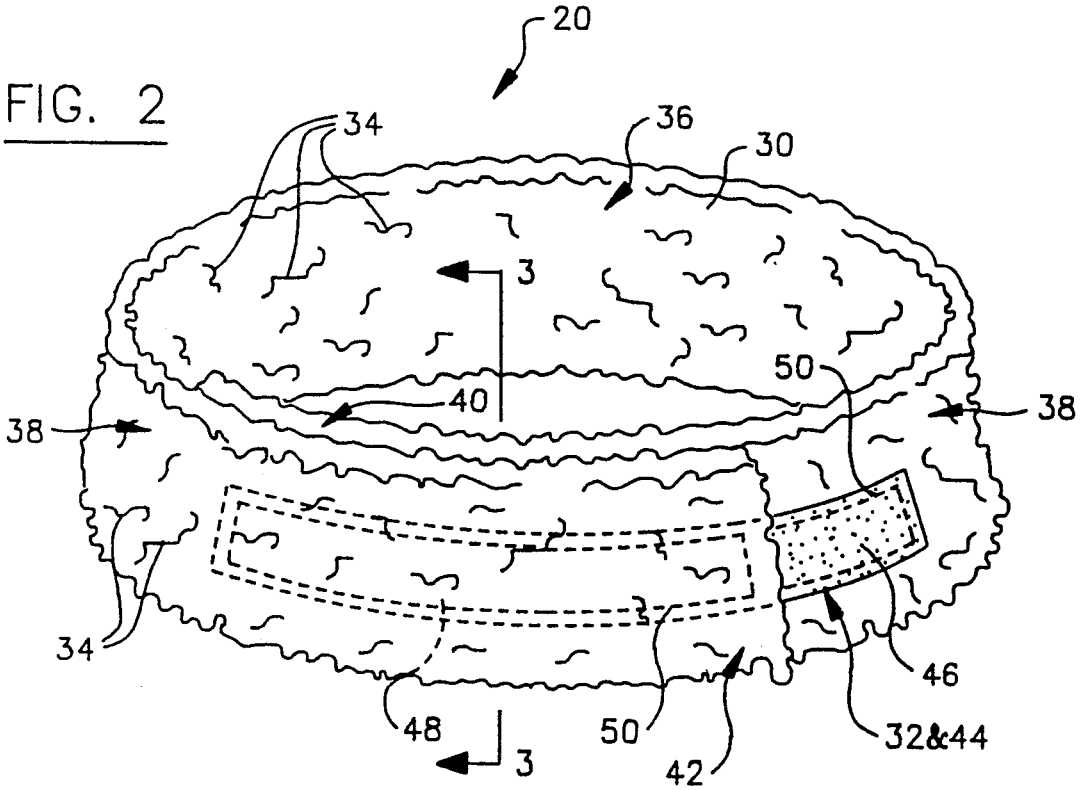
FIG. 2 is an isometric view of the embodiment shown in FIG. 1.
Figure 3:
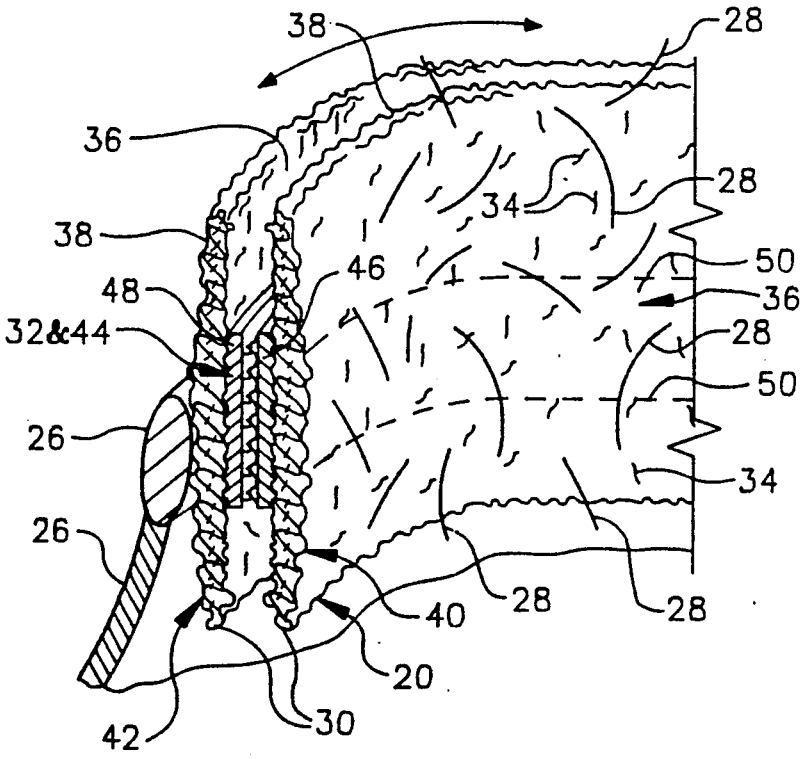
FIG. 3 is a partial, cross-sectional, isometric view taken along line 2—2 of FIG. 2.

Referring to the drawings, wherein like numerals indicate like parts, an apparatus 20 of the present invention may be placed between a neck 22 of a person 24 and a generally large protective cape 26. Cape 26 is illustrated in phantom lines within FIG. 1. Apparatus 20 serves to absorb liquid (not shown) and stop lengths of cut hair 28 from running down neck 22 of person 24. Many segments of cut hair 28 are illustrated in FIG. 3 as piercing or being imbedded or impaled into apparatus 20. To accomplish these tasks, apparatus 20 generally comprises an elongated length of cloth 30, and means 32 for fastening and securing length of cloth 30 about neck 22 of person 24.

The elongated length of cloth 30 is preferably made of a soft, flexible material which is capable of quickly absorbing liquid. In the preferred embodiment, length of cloth 30 is made of a cotton terry cloth or pile fabric, commonly used for bath towels and robes, having uncut loops 34 on one or both sides. Uncut loops 34 are indicated in the Figures as generally irregular lines on an inner surface 36 and on an outer surface 38 of cloth 30. Such cloth 30 is capable of absorbing and retaining an immense amount of liquid. Uncut loops 34 of the fabric also serve as a medium into which lengths of cut hair 28 may be impaled, imbedded, or captured. Such cloth 30 is also capable of being easily and inexpensively laundered and reused over and over again.

As can be seen in the Figures, cloth 30 has a first end 40 at one end and a second end 42 at an opposite end thereof. Cloth 30 also has inner surface 36 which may be juxtaposed against neck 22 of person 24, and outer surface 38 which faces away from neck 22 of person 24 when apparatus 20 is used.

It is important that the length of cloth 30 be capable of at least surrounding a girth of neck 22 of person 24 in such a manner that first end 40 at least partially overlaps second end 42. Thus configured, cloth 30 defines a collar, choker, or neck band when used. The term cloth 30 will be used herein as a synonym for collar, choker, and neck band.

When applied, protective cape 26 is removably secured about neck 22 of person 24 such that cape 26 is placed over outer surface 38 of cloth 30. Thus, cloth 30 serves as a gasket or seal between protective cape 26 and neck 22 of person 24.

Fastening means 32 enables cloth 30 to be secured about neck 22 of person 24. For example, fastening means 32 may comprise a hook and loop fastener system 44 similar to that sold under the trademark VELCRO. A length of looping segment 46 is secured to outer surface 38 of cloth 30 near first end 40 such that looping segment 46 and cloth 30 are generally coaxial. Similarly, a length of hooking segment 48 is secured to inner surface 36 of cloth 30 near second end 42 such that hooking segment 48 and cloth 30 are generally coaxial. It must be understood that the positions of looping segment 46 and hooking segment 48 may be respectively reversed and still accomplish the task at hand.

Looping segment 46 and hooking segment 48 may be secured to cloth 30 by any adequate means such as by sewing (generally indicated by a stitched seam 50), use of an adhesive (not shown), or similar means of attachment. Thus configured, first end 40 of cloth 30 is capable of passing over second end 42 of cloth 30 in such a manner that they overlap and enable looping segment 46 to removably and adjustably engage and mesh with hooking segment 48.

Alternative fastening means 32 may comprise a plurality of meshing snaps (not shown) placed along the respective lengths of first end 40 and second end 42 of cloth 30. An increased number of snaps gives apparatus 20 a greater number of available girth sizes and enables the length of cloth 30 to be adjusted. The most versatile and easily adjusted fastening means 32, however, is believed to be the above-described hook and loop fastening system 44.

The present invention also contemplates use of a liquid absorbent powder (not shown) which may be sprinkled onto cloth 30 or onto neck 22 of person 24 before cloth 30 is fastened in place. For example, the powder may comprise a talcum powder, a baking powder, a body power, a baby powder, or any other similar product that provides a smooth bearing surface between neck 22 of person 24 and inner surface 36 of cloth 30. Use of a powder reduces any likelihood of chaffing, and, if the powder is scented, gives off a pleasant aroma for increase relaxation and smoother comfort for person 24 or the customer.

In addition, the present invention includes a method of preventing liquid or lengths of cut hair 28 from running down neck 22 of person 24 comprising the steps of:

(a) wrapping the above-described length of cloth 30 around neck 22 of person 24, (b) removably and adjustably engaging and meshing looping segment 46 with hooking segment 48 to fasten and secure first end 40 to second end 42 and thereby fasten and secure the length of cloth 30 about neck 22 of person 24; and (c) removably securing protective cape 26 about neck 22 of person 24 such that cape 26 is placed over the length of cloth 30.

An additional step may include sprinkling the liquid absorbent powder onto the length of cloth 30 or onto neck 22 of person 24 prior to wrapping cloth 30 around neck 22 of person 24. That step may be even more specific to require that the type of powder be either talcum power, baking powder, body power, or baby powder.

A further step may include moving or rotating the length of cloth 30 about neck 22 of person 24 prior to removing cloth 30 therefrom. This step of moving or rotating the length of cloth 30 causes the lengths of cut hair 28 to become impaled, imbedded, or captured within the length of cloth 30, and, therefore, become more easily removed.

An even further step may include laundering cloth 30 after it becomes used and/or soiled.

The benefits of the present invention are more readily ascertained by reference to the following example of its use.

Once manufactured, the soft, flexible inner surface 36 of cloth 30 is wrapped around and juxtaposed against neck 22 of person 24. Fastening means 32 is then engaged to fasten and secure the respective first end second ends 40 and 42 of cloth 30 to provide a close but comfortable fit. The fit should be tight enough to prevent liquid and cut hair 28 from passing down neck 22 of person 24.

If desired, and particularly if neck 22 of person 24 is wet, a talcum, baking, baby, or other powder may be sprinkled onto the choker or neck band and/or onto neck 22 of person 24 prior to attachment. Such powder helps to prevent neck 22 from becoming chaffed.

Cape 26 is then placed against outer surface 38 of cloth 30 and fastened into position.

After the person's hair has been washed and/or cut and all excess liquid and cut hair 28 have been removed, cape 26 may be unfastened and removed. Fastening means 32 is then unfastened and cloth 30 removed.

One of the important added benefits of the present invention is that escaped cut hair 28 is easily impaled and embedded into uncut loops 34 of the fabric material from which cloth 30 is manufactured. Thus, cloth 30 serves to actually capture and hold short segments of cut hair 28 and remove such cut hair 28 from neck 22 of person 24. Due to this added benefit and feature of the present invention, the inventor prefers to move or rotate cloth 30 about neck 22 of person 24 prior to removing cloth 30. This movement enables stray cut hair 28 to become better embedded or impaled within the inner sidewalls of the collar.

It should be expected that the inner and outer surfaces 36 and 38 of the sidewalls of cloth 30 will become soiled. Therefore, once cloth 30 is removed, cloth 30 may be set aside for later laundering and reuse.

The means and construction disclosed herein are by way of example and comprise primarily the preferred form of putting the invention into effect. Although the drawings depict a preferred embodiment of the invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its forms, including all modifications, equivalents, and alternative embodiments which fall within the legitimate and valid scope of the appended claims, appropriately interpreted under the Doctrine of Equivalents.

Industrial Applicability

The present invention provides a simple, reliable, easily manufactured and used apparatus and method for absorbing liquid and/or stopping cut hair from running down a person's neck when that person's hair is washed and/or cut. The apparatus of this invention is efficient, functional, compact, unobtrusive, reusable, durable, rugged, is easily constructed, and is inexpensive and economical to manufacture. Traditional or nontraditional manufacturing processes may be used. The present invention not only increases the speed and simplifies the procedure to attach an absorbent material to the neck of a person, it also provides an apparatus which is dramatically more efficient in catching liquid and loose cut hair. The present invention also requires the manufacture and use of a fewer number of elements and is much less complex than previously was thought necessary, as evidenced in the above-identified patents.

I claim:

1. A method for preventing liquid or lengths of cut hair from running down a neck of a person comprising the steps of:

(a) wrapping an elongated length of soft, flexible cloth or other liquid absorbent material around the neck of the person, said length of cloth having (i) a first end at one end, (ii) a second end at an opposite end thereof, (iii) an inner surface which may be juxtaposed against the neck of the person, (iv) an outer surface which faces away from the neck of the person when used, said length of cloth capable of at least surrounding a girth of the neck of the person to define a collar, choker, or neck band when used, and (v) means for fastening and securing said length of cloth about the neck of the person, said fastening means enabling said first end to pass over said second end and be removably and adjustably secured thereto, said fastening means comprising a hook and loop fastener system having a looping segment secured near said first end and a hooking segment secured near said second end, said hooking segment capable of removably and adjustably engaging and meshing with said looping segment, said cloth capable of absorbing liquid, said cloth having a plurality of uncut loops into which lengths of the cut hair may be impaled, imbedded, or captured, said cloth capable of being laundered and reused;

(b) removably and adjustably engaging and meshing said hooking segment with said looping segment to fasten and secure said first end to said second end and thereby fasten and secure said length of cloth about the neck of the person;

(c) removably securing a protective cape about the neck of the person such that said cape is placed over said length of cloth, said length of cloth serving as a gasket or seal between said cape and the neck of the person; and (d) moving or rotating said length of cloth about the neck of the person prior to removing the length of cloth from around the neck of the person, said step of moving or rotating said length of cloth causing the lengths of cut hair to become impaled, imbedded, or captured within said uncut loops of said cloth.

* * * * *